US005193491A

United States Patent [19]

Oslin et al.

[11] Patent Number: 5,193,491

[45] Date of Patent: Mar. 16, 1993

[54] CLEANING SYSTEM FOR BOILER

[75] Inventors: G. Robert Oslin, Chicago; James R. Buchler, Orland Park; Robert E. Johnson, Oakbrook Ter., all of Ill.

[73] Assignee: Delaware Capital Formation, Inc., Wilmington, Del.

[21] Appl. No.: 678,815

[22] Filed: Apr. 1, 1991

[51] Int. Cl.[5] ..... F22B 37/48; F28G 9/00

[52] U.S. Cl. ..... 122/401; 210/177

[58] Field of Search ..... 122/379, 382, 396, 401, 122/405; 210/177

[56] References Cited

U.S. PATENT DOCUMENTS 3,581,714 6/1971 Smith .
4,276,856 7/1981 Dent et al. ..... 122/405
4,285,302 8/1981 Kelly .
4,287,407 9/1981 Treiber et al. .
4,453,499 6/1984 Palmer .
4,465,026 8/1984 Carberry .
4,823,767 4/1989 Wüst .
4,903,642 2/1990 Tamaru et al. .
4,905,900 3/1990 Scharton et al. ..... 122/405

*Primary Examiner*—Henry C. Yuen
*Attorney, Agent, or Firm*—Welsh & Katz, Ltd.

[57] ABSTRACT

A cleaning system for cleaning the interior of a boiler wherein the system includes a cleaning solution reservoir adapted for mounting within an appliance in which the boiler is housed, and a flow conduit circuit having eductor means operative to draw cleaning solution from the reservoir and pass it to the interior of the associated boiler when water under pressure is introduced into the eductor. The system finds particular application in descaling boilers employed in steam cooking ovens and the like wherein the boilers are relatively inaccessible.

14 Claims, 1 Drawing Sheet

CLEANING SYSTEM FOR BOILER

BACKGROUND OF THE INVENTION

The present invention relates generally to cleaning of boiler interiors, and more particularly to a novel system for cleaning boilers which finds particular application in de-scaling boilers of apparatus having boilers that are difficult or inconvenient to access.

A major problem with any device which heats or boils water is scale buildup in the boiler. Dissolved solids in the water precipitate and bond to surfaces in contact with the water. This scale can build up to levels which cause blockage of drains, damage valves, cause heater failure in electric boilers, and greatly reduce efficiency in gas-fired units.

One technique to reduce scale buildup in boilers is to employ a water conditioner which removes solids from the water being introduced into the boiler. However, such water conditioners are relatively expensive and require regular maintenance. A more common practice is to periodically de-scale the boilers. This is generally done by introducing a strong acid, such as phosphoric acid, into the boiler. The acid is allowed to stand and dissolve the scale, after which the boiler is flushed and drained to remove the acid and dissolved scale. This technique has been found quite satisfactory but presents a significant safety problem when introducing the acid into the boiler.

The safety problems inherent in introducing acid descaling solutions into boilers are particularly acute when cleaning gas-fired boilers or combination steam and dry air cooking ovens and the like wherein the boilers are housed within the oven cabinets rearwardly of associated cooking compartments. Such boilers are commonly accessed from the top rear of the oven cabinet generally through a pressure relief port or fill port at the top of the boiler. This often makes it necessary to climb on top of the cabinet which may be hot from use, slippery from cooking grease, or located close to other equipment. Moreover, since such access is carried out while holding strong acids, the safety problems are magnified. Also, since commercial oven units are often double stacked, additional problems are presented by the height of the access port in the upper boiler, and the increased difficulty in reaching the access port in the lower boiler. In addition to overcoming safety problems, boiler cleaning systems should be simple in operation and not require service calls or the use of specialized tools.

SUMMARY OF THE INVENTION

One of the primary objects of the present invention is to provide a novel boiler cleaning system which overcomes the aforedescribed disadvantages found in prior boiler cleaning systems.

A more particular object of the invention is to provide a novel boiler cleaning system which employs a cleaning agent reservoir preferably supported beneath or within a cabinet that houses the boiler to be cleaned, the reservoir having a fill tube accessible from the front of the cabinet and having flow conduit means including eductor means operable to introduce the cleaning agent, such as a de-scaling agent, into the boiler in a reliable, safe and relatively simple manner without need for specially trained technicians.

Another object of the present invention is to provide a relatively simple system for cleaning boilers as aforedescribed but which can be readily modified to facilitate selective cleaning of a plurality of discrete boilers on stacked oven units or the like while drawing the cleaning agent from a common readily fillable reservoir.

Further objects, advantages and features of the present invention will become apparent from the following detailed description when taken in conjunction with the accompanying drawing wherein like reference numerals designate like elements throughout the several views.

DETAILED DESCRIPTION

Figure 1:
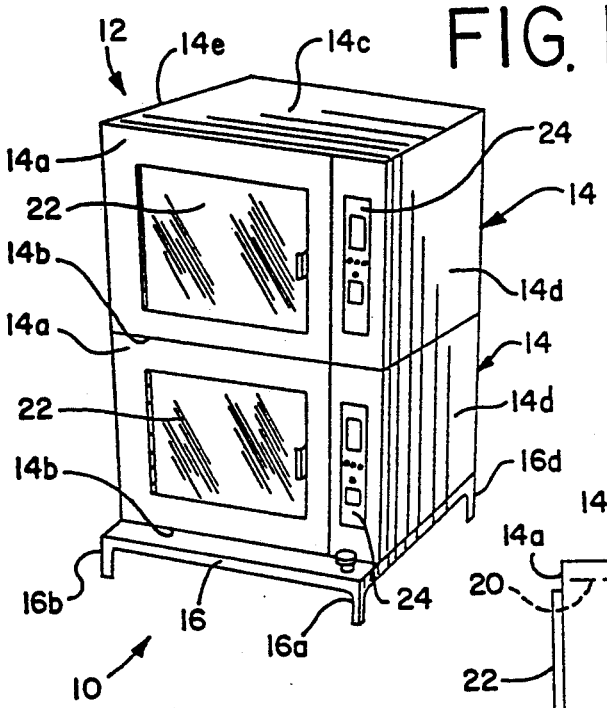
FIG. 1 is a perspective view of a pair of stacked combination steam and dry air cooking ovens employing gas-fired boilers and a boiler cleaning system in accordance with the present invention.

Referring now to the drawing, and in particular to FIG. 1, a pair of substantially identical appliances in the form of gas-fired combination steam and dry air cooking ovens are illustrated in stacked relation at 10 and 12, respectively. The ovens 10 and 12 are of the type operative to effect forced convection cooking with superheated steam, saturated steam, or heated air, such as disclosed in U.S. Pat. No. 4,817,582 which is incorporated herein by reference. Briefly, the ovens 10 and 12 may be free standing or may be stacked in vertical relation as illustrated. Each oven includes a generally rectangular cabinet 14 having a front wall 14*a*, a bottom end 14*b*, a top wall 14*c* and substantially parallel side walls 14*d* and 14*e*. The rear of each cabinet 14 may be open or may have a rear wall, preferably perforated, connected thereto. In the illustrated embodiment, the lower oven 10 has a base or support frame 16 having corner legs 16*a–d* to facilitate spacing of the lower or bottom end of the oven from a floor surface 18 or other support surface.

Figure 2:
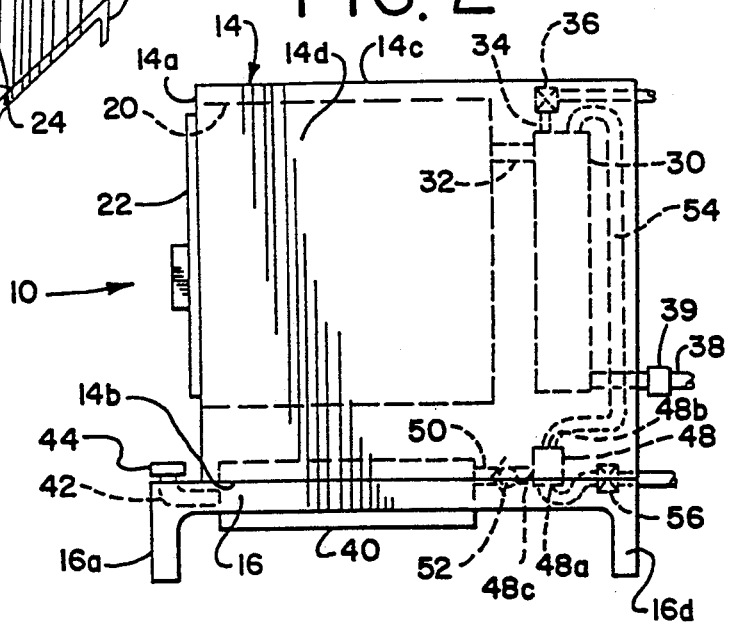
FIG. 2 is a side elevational view of one of the gas-fired combination steam and dry air cooking ovens of FIG. 1, with certain internal components shown schematically in hidden lines.

Each of the cooking ovens 10 and 12 has a generally rectangular internal oven chamber or compartment, indicated schematically at 20 in FIG. 2, which defines a cooking or food processing chamber accessible through a door 22 hinged to the front wall of the corresponding cabinet 14. The internal cooking chamber 20 preferably has removable support racks (not shown) for supporting items during cooking. A control panel, such as indicated at 24, is supported on the front wall 14*a* of each cooking oven 10 and 12 and has a key pad, push buttons and dials, and a digital display which enable programmed operation of the corresponding cooking oven as disclosed in the aforementioned U.S Pat. No. 4,817,582.

For purposes of illustration, each of the cooking ovens 10 and 12 has a boiler, such as indicated schematically at 30 in FIG. 2, supported in upstanding relation within the corresponding cabinet 14 rearwardly of the cooking chamber 20. As disclosed in U.S. Pat. No. 4,817,582, the boiler may be heated by a plurality of vertically stacked gas burners (not shown) which have their combustion products passed through fire tube channels to heat water in the boiler and generate steam. The boiler preferably has fill and drain lines and associated valving disposed at the rear of the corresponding cabinet. The boiler 30 is connected to the cooking chamber 20 through one or more steam conduits, one of which is indicated schematically at 32, enabling passage of steam from the boiler to the cooking chamber. The boiler 30 has an inlet port 34 at its upper end adapted for connection to a water supply through an electronically controlled valve 36 to enable introduction of water into the boiler for heating by a gas or electric heater. The boiler has a drain line 38 at its lower end controlled by an electronically actuated drain control valve 39 to facilitate draining of water from the boiler or, as will be described, drainage of cleaning solution and removed scale after completion of a cleaning cycle.

In accordance with the present invention, a cleaning system is provided which may be utilized to clean the interior of the boiler 30 of each of the ovens 10 and 12 when in individual free standing conditions, or alternatively, may be employed with two or more of the ovens having discrete boilers and disposed in stacked relation, as illustrated in FIG. 1. Referring to FIG. 2, a reservoir or tank 40 is supported adjacent the bottom of the oven 10 so that the reservoir lies beneath the cooking chamber 20 of oven 10. The reservoir has a fill tube 42 which extends forwardly from the front 14*a* of cabinet 14 and terminates in an upwardly directed fill opening having a releasible fill cap 44. The reservoir or tank 40 is made from a suitable material to withstand liquid commercial cleaning or de-scaling agents such as vinegar and phosphoric acid. The reservoir or tank 40 may be made, for example, from acid resistent polypropolene or other suitable plastic and is adapted to receive a quantity of a de-scaling agent in solution form through the fill tube 42. Alternatively, the reservoir may, after flushing to remove any de-scaling agent, receive a degreasing agent, such as sulfamic acid, for degreasing the interior of the oven by circulating degreasing fumes internally of the oven.

When the cleaning system is employed with a single cooking oven, such as oven 10, the reservoir 40 is connected to eductor means in the form of a conventional eductor 48 having a first inlet port 48*a* adapted for connection to a water supply, a second inlet port 48*b* adapted for connection to the reservoir or tank 40, and an outlet port 48*c* adapted for connection to the boiler 30. The reservoir 40 is connected to the inlet port 48*b* of eductor 48 through a fluid flow conduit 50 having unidirectional flow control means in the form of a check valve 52 adapted to prevent flow from the eductor 48 to the reservoir. The outlet port 48*c* of the eductor 48 is connected to the top of the boiler 30 through a fluid flow conduit 54. The inlet port 48*a* of the eductor 48 is connected to a water supply through a control valve 56 enabling selective introduction of water under pressure from the water supply to the inlet port 48*a* of the eductor. The eductor 48 is adapted to operate over a water pressure range of approximately 20–70 psi. The control valve 56 is preferably an electrically controlled solenoid operated valve connected in a control circuit controlled through the control panel 24.

In the operation of the cleaning system when employed to de-scale the boiler in the single oven 10, and with the reservoir or tank 40 filled with a full-strength de-scaling solution, the operator enters a "clean cycle" code on the control panel 24 to initiate a programmed automatic boiler de-scaling or clean cycle which may last for approximately 45 minutes. The boiler clean cycle program first causes the boiler 30 to be drained through the drain line 38 to remove any water present in the boiler. The clean cycle program then automatically closes the drain valve 39 and opens the control valve 56 to introduce pressurized water into the inlet port 48*a* of eductor 48. This action draws de-scaling solution from the reservoir 40 through check valve 52 to the eductor where the de-scaling solution is admixed with water passing through the eductor. The admixed water/de-scaling solution is passed from the outlet port 48*c* of the educator through the conduit 54 to the top of the boiler 30.

When the de-scaling mixture reaches a level within the boiler 30, as detected by a fluid level sensor (not shown) within the boiler or by timed opening of valve 56, the valve 56 is closed. The de-scaling solution within boiler is then heated to approximately 150° F. and maintained at the temperature for a period of time. The de-scaling solution is then boiled within the boiler for a period of time, such as approximately 10 minutes, to create a violent steam action within the boiler which breaks off scale buildup, such as lime, on the internal walls of the boiler. Simultaneously, the steam from the boiling de-scaling solution within the boiler may be passed through the cooking chamber 20 to effect de-scaling and cleaning of the walls of the cooking chamber and the support racks therein.

After completion of a cleaning or de-scaling cycle, as determined by a programmed controller controlled by the control panel 24, the boiler heater is terminated and a rinse stage is initiated wherein the boiler is drained of scale and de-scaling solution with drain valve 39 open and refilled and flushed with clean water introduced through the valve controlled water inlet 34 at the top of the boiler. The clean water is brought to a boil and subsequently drained at which time the controller provides an audible signal that the de-scaling or clean cycle is complete and increments a non-resettable counter to provide an indication on the control panel 24 of the total number of clean cycles performed on the boiler.

During cleaning or de-scaling of the boiler 30 as aforedescribed, the unidirectional control valve 52 prevents back flow of water into the de-scaling solution reservoir or tank 40 from the eductor in the event that the boiler fill line 54 becomes blocked or otherwise obstructed. The check valve 52 also prevents any air present in the fluid flow conduits 50 or 54 from bubbling up through the cleaning solution tank and spraying acid out of the fill port 42.

Figure 3:
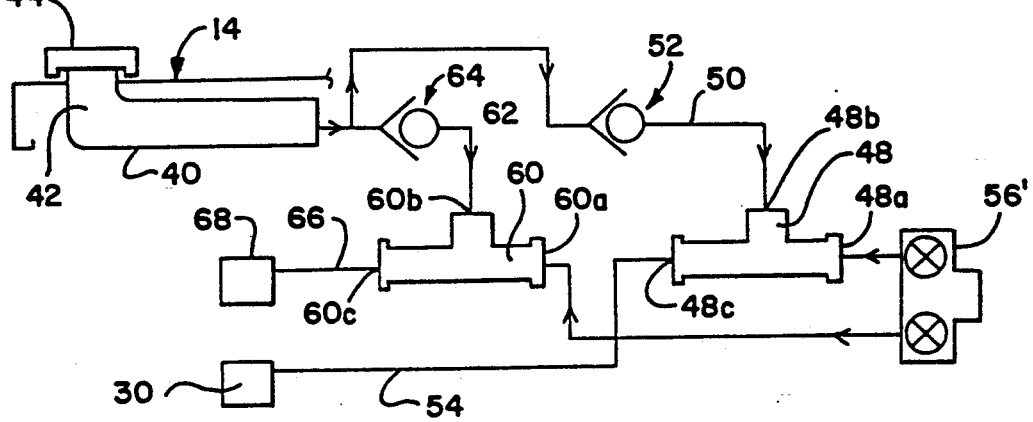
FIG. 3 is a schematic circuit diagram of a boiler cleaning system in accordance with the present invention as employed in the stacked cooking ovens of FIG. 1.

As aforementioned, the boiler cleaning system in accordance with the present invention may be applied to a single oven, such as the system described for the oven 10, or may be modified for use with at least two ovens mounted in stacked relation as shown in FIG. 1. FIG. 3 is a schematic circuit diagram of a boiler cleaning system for use with the stacked ovens 10 and 12 of FIG. 1. The elements of the system of FIG. 3 which are common to the aforedescribed boiler cleaning or de-scaling system for the single oven 10 are represented by the same reference numerals.

A feature of the cleaning or de-scaling system illustrated in FIG. 3 is that a common cleaning or de-scaling agent reservoir or tank 40 is employed for supplying cleaning or de-scaling solution to either oven 10 or oven 12. The cleaning system of FIG. 3 employs a conventional electronically controlled three-way control valve 56' which is selectively operable to introduce water under pressure to the eductor 48, or to a first inlet port 60*a* of an eductor 60 which has a second inlet port 60*b* connected through a flow conduit 62 to the cleaning solution reservoir 40. A unidirectional flow control valve in the form of a check valve 64 is connected in the flow conduit 62 to enable flow of cleaning solution from reservoir 40 to eductor 60 but prevent reverse flow. The eductor 60 is substantially identical to eductor 48 and has an outlet port 60*c* connected through a conduit 66 to a boiler, indicated schematically at 68, supported within the cabinet of oven 12 is similar fashion to the boiler 30 in oven 10. The control valve 56' is connected in circuit with a programmed controller associated with the control panel 24 of oven 12 so as to enable initiation of a programmed cleaning cycle for cleaning and/or de-scaling the interior of boiler 68 in substantial identical fashion to the aforedescribed cleaning or de-scaling cycle for boiler 30.

From the foregoing description, it is seen that the present invention provides a boiler cleaning system employing eductor means in a relatively simple and efficient system which finds particular application in de-scaling a relatively inaccessible boiler in a single oven, or alternatively, selectively cleaning or de-scaling discrete relatively inaccessible boilers disposed in stacked ovens.

While preferred embodiments of the boiler cleaning system in accordance with the present invention have been illustrated and described, it will be understood that changes and modifications may be made therein without departing from the invention in to broader aspects. Various features of the invention are defined in the following claims.

What is claimed is:

1. In a boiler apparatus having a generally upstanding cabinet, a boiler disposed within the cabinet and being of the type in which a residue may build up during use, the combination therewith comprising a cleaning system including:

a reservoir supported within the cabinet and adapted to receive a liquid cleaning agent;

educator means having a first inlet port adapted for connection to a water supply, a second inlet port, and an outlet port;

first fluid conduit means interconnecting said second inlet port to said reservoir; and second fluid conduit means interconnecting said outlet port to said boiler;

said educator means being operable to draw cleaning liquid from said reservoir when water is introduced under pressure into said first inlet port, and effect flow of admixed cleaning liquid and water to the boiler, said reservoir having a fill tube accessible from externally of a side of the cabinet to enable filling of the reservoir with a cleaning agent.

2. Boiler apparatus as defined in claim 1 including unidirectional flow control means connected in said first fluid conduit means to prevent flow of liquid from said educator means to said reservoir.

3. Boiler apparatus as defined in claim 1 wherein the upstanding cabinet has front, bottom and top walls, and defines a compartment therein, said reservoir being supported within said cabinet generally adjacent the bottom wall, and said fill tube being accessible from the front of said cabinet to enable filling of the reservoir with a cleaning solution.

4. Boiler apparatus as defined in claim 3 wherein said fill tube extends forwardly form the front of said cabinet and has a releasable fill cap.

5. Boiler apparatus as defined in claim 3 wherein said boiler is supported within said cabinet in a generally vertical orientation, said second fluid conduit means interconnecting the outlet port of said eductor means to the upper end of said boiler.

6. Boiler apparatus as defined in claim 3 wherein said cabinet constitutes a first cabinet, and including a second cabinet supported on top of said first cabinet and having a discrete boiler therein, said cleaning system including second eductor means having a first inlet port adapted for connection to said water supply, a second inlet port, and an outlet port, discrete fluid conduit means connecting said second inlet port of said second eductor means to said reservoir, and discrete fluid conduit means connecting said outlet port of said second eductor means to said boiler in said second cabinet, said second eductor means being operative to draw cleaning solution form said reservoir and transfer said cleaning solution to the boiler within said second cabinet when water is introduced under pressure into said first inlet port of said second eductor means.

7. Apparatus as defined in claim 6 including first unidirectional flow control means connected in said fluid conduit means interconnecting said first eductor means to said reservoir, and second unidirectional flow control means connected in said fluid conduit means interconnecting said second eductor means to said reservoir, said first and second unidirectional flow control means being operative to prevent flow of liquid form said second eductor means to said reservoir.

8. Apparatus as defined in claim 6 including control valve means connected to the first inlet ports of said first and second eductor means to selectively control flow of water from the water supply to said first and second eductor means.

9. Boiler apparatus comprising, in combination: a cabinet having upstanding walls defining an internal compartment; a boiler supported within said compartment and being of the type in which a residue may build up during use; a reservoir supported within said cabinet and adapted to receive a liquid cleaning agent therein; pump means adapted for connection to a water supply; first fluid conduit means interconnecting said pump means to said reservoir; and second fluid conduit means interconnecting said pump means to said boiler; said pump means being operable to receive cleaning liquid for the reservoir and water from the water supply and effect flow of admixed cleaning liquid and water to the boiler, said reservoir having a fill tube accessible from externally of a side of said cabinet to enable operator filling of the reservoir with a cleaning agent without interrupting operation of the boiler.

10. Boiler apparatus as defined in claim 9 including unidirectional flow control means connected in said first fluid conduit means to prevent flow of liquid from said pump means to said reservoir.

11. Boiler apparatus as defined in claim 9 wherein the upstanding cabinet has front, bottom side and top walls defining said internal compartment, said reservoir being supported within the cabinet generally adjacent said bottom wall, said fill tube extending outwardly from the front wall of the cabinet to enable filling of the reservoir with a cleaning solution.

12. Apparatus as defined in claim 11 including a releasable fill cap mounted on an outer end of said fill tube forwardly form the front of the cabinet.

13. Apparatus as defined in claim 11 wherein the boiler is supported within the cabinet in a generally vertical orientation, said second fluid conduit means interconnecting said pump means to the upper end of said boiler.

14. Apparatus as defined in claim 11 wherein said cabinet constitutes a first cabinet, and including a second cabinet supported on top of said first cabinet and having a discrete boiler therein, second pump means adapted for connection to the water supply, discrete fluid conduit means connecting said second pump means to said reservoir, and discrete fluid conduit means connecting said second pump means to said boiler within said second cabinet, said second pump means being operative to draw liquid cleaning agent for the reservoir and water from the water supply and effect flow of admixed liquid cleaning agent and water to the boiler within said second cabinet, said reservoir having a fill tube accessible from externally of said first cabinet to enable filling of the reservoir with a cleaning agent without interrupting operation of the boilers.

* * * * *

UNITED STATES PATENT AND TRADEMARK OFFICE

CERTIFICATE OF CORRECTION

PATENT NO. : 5,193,491

DATED : March 16, 1993

INVENTOR(S) : G. R. Oslin et al.

It is certified that error appears in the above-identified patent and that said Letters Patent is hereby corrected as shown below:

Column 4, line 12, change "educator" to --eductor--;

Column 5, line 36, delete the first occurrence of "a";

Column 5, lines 43 and 51, change "educator" to --eductor--;

Column 5, line 61, change "educator" to --eductor--;

Column 6, line 52, change "for" to --from--;

Column 6, line 63, insert a comma (,) after "bottom";

Column 7, line 3, change "form" to --from--;

Column 8, line 6, change "for" to --from--.

Signed and Sealed this

Eighteenth Day of January, 1994

*Attest:*

Bruce Lehman

BRUCE LEHMAN

*Attesting Officer*

*Commissioner of Patents and Trademarks*